US008451180B2

(12) United States Patent
Bonwit et al.

(10) Patent No.: US 8,451,180 B2
(45) Date of Patent: May 28, 2013

(54) INTEGRATED ANTENNA AND DISPLAY SHADE

(75) Inventors: Holden Bonwit, Simi Valley, CA (US); Abraham Hartenstein, Chatsworth, CA (US)

(73) Assignee: AeroVironment, Inc., Monrovia, CA (US)

( * ) Notice: Subject to any disclaimer, the term of this patent is extended or adjusted under 35 U.S.C. 154(b) by 621 days.

(21) Appl. No.: 12/624,163

(22) Filed: Nov. 23, 2009

(65) Prior Publication Data

US 2011/0122029 A1 May 26, 2011

(51) Int. Cl.
*H01Q 1/24* (2006.01)
*H01Q 19/10* (2006.01)

(52) U.S. Cl.
USPC ..... 343/702; 343/872; 343/834; 343/818

(58) Field of Classification Search
None
See application file for complete search history.

(56) References Cited

U.S. PATENT DOCUMENTS

| | | | | |
|---|---|---|---|---|
| 1,689,400 | A | 10/1928 | Manley | |
| 2,850,731 | A | 9/1958 | Carlson | |
| 3,961,159 | A | 6/1976 | Hursey | |
| 4,569,572 | A | 2/1986 | Kopich | |
| 5,218,474 | A | 6/1993 | Kirschner | |
| 5,233,468 | A | 8/1993 | McNulty | |
| 5,325,970 | A | 7/1994 | Dillon et al. | |
| 5,337,066 | A * | 8/1994 | Hirata et al. | 343/841 |
| 5,767,807 | A | 6/1998 | Pritchett | |
| 5,926,145 | A | 7/1999 | Honma | |
| 6,104,348 | A * | 8/2000 | Karlsson et al. | 343/700 MS |
| 6,236,373 | B1 | 5/2001 | Park | |
| 7,313,409 | B2 | 12/2007 | Iacono et al. | |
| 7,463,201 | B2 * | 12/2008 | Chiang et al. | 343/702 |
| 2002/0175862 | A1 * | 11/2002 | Hunter et al. | 343/700 MS |
| 2002/0186180 | A1 | 12/2002 | Duda | |
| 2003/0075606 | A1 | 4/2003 | Connolly et al. | |
| 2004/0051670 | A1 | 3/2004 | Sato | |
| 2004/0196265 | A1 | 10/2004 | Nohr | |
| 2004/0239577 | A1 * | 12/2004 | Delgado et al. | 343/872 |
| 2006/0061512 | A1 | 3/2006 | Asano et al. | |
| 2006/0237239 | A1 | 10/2006 | Bruner et al. | |
| 2006/0279916 | A1 | 12/2006 | Boudreau | |
| 2007/0030210 | A1 * | 2/2007 | Shibata | 343/893 |
| 2007/0055396 | A1 | 3/2007 | Hedges et al. | |
| 2007/0064109 | A1 | 3/2007 | Renkis | |
| 2008/0088513 | A1 | 4/2008 | Saitou | |

(Continued)

OTHER PUBLICATIONS

Wikipedia, Yagi antenna, http://en.wikipedia.org/wiki/Yagi_antenna, accessed Jul. 2, 2009, 5 pages.

(Continued)

*Primary Examiner* — Trinh Dinh
(74) *Attorney, Agent, or Firm* — Christopher R Ralzan; Eric J. Aagaard

(57) ABSTRACT

In one embodiment, an integrated antenna and display shade for a wireless portable control unit is provided which includes a stowable display shade having two side panels and a front panel between the two side panels. Each of the two side panels are foldably connected to opposing edges of the front panel so as to be capable of folding into planes generally parallel with a plane of the front panel when stowed and into planes generally orthogonal to the plane of the front panel when deployed to shade a visual display. The front panel includes an active antenna and each of the side panels include a parasitic antenna.

30 Claims, 6 Drawing Sheets

U.S. PATENT DOCUMENTS

| | | | | |
|---|---|---|---|---|
| 2008/0097695 | A1 | 4/2008 | Tanaka et al. | |
| 2009/0004948 | A1 | 1/2009 | Ando et al. | |
| 2009/0009413 | A1 | 1/2009 | Su et al. | |
| 2009/0268300 | A1 | 10/2009 | Dai et al. | |
| 2011/0216064 | A1* | 9/2011 | Dahl et al. | 345/428 |

OTHER PUBLICATIONS

PCT International Searching Authority, International Search Report (ISR) for PCT/US10/57669 (entitled Integrated Antenna and Display Shade by Bonwit and Hartenstein), mailed Feb. 23, 2011, from US International Searching Authority.

PCT International Searching Authority, Written Opinion of the International Searching Authority (WO) for PCT/US10/57669 (entitled Integrated Antenna and Display Shade by Bonwit and Hartenstein), mailed Feb. 23, 2011, from US International Searching Authority.

PCT International Searching Authority, Examiner's Search History for PCT/US10/57669 (entitled Integrated Antenna and Display Shade by Bonwit and Hartenstein), mailed Feb. 23, 2011, from US International Searching Authority.

Glare Stopper, Glarestopper—Garmin Magellan TomTom GPS Device Unit Anti-Glare, http://www.glarestomper.com, accessed May 14, 2009, 2 pages.

Scala Leathergoods, GPS & Navigation Accessories, http://www.scala.com.au/epages/Scala.sf/en_AU/?ObjectPath=/Shops/Scala/Categories/GPS, accessed May 14, 2009, 1 page.

Scala Leathergoods, navGEAR sun visor, http://www.scala.com.au/epages/Scala.sf/en_AU/?ObjectPath=/Shops/Scala/Categories/GPS, accessed May 14, 2009, 1 page.

* cited by examiner

INTEGRATED ANTENNA AND DISPLAY SHADE

BACKGROUND

Current remote control units for remote control vehicles, such as unmanned areal vehicles or UAVs, use multiple modules—a lightweight handheld remote control unit, and a power and antenna radio link module separate from the handheld remote. Although this approach provides a good signal link between the handheld remote and the remote control vehicle, it is not lightweight or easily portable, as the antenna array requires significant infrastructure and time to set up.

Simply placing the radio transmitter/receiver in the handheld remote is not sufficient because RF link quality can suffer. A traditional RF antenna extending from the housing of the handheld remote control would be easy to break. A robust external RF antenna sacrifices link quality and incurs weight in a handheld unit. Putting an antenna within the housing of the remote provides a robust solution, but the antenna would be small and less efficient, so it would compromise link quality.

What is needed is an easy to use, portable, and robust handheld remote control and antenna for remotely controlling vehicles. Furthermore, what is needed is a lightweight handheld remote control that does not sacrifice RF link quality.

SUMMARY

In one embodiment, an integrated antenna and display shade for a wireless portable control unit is provided which includes a stowable display shade having two side panels and a front panel between the two side panels. Each of the two side panels are foldably connected to opposing edges of the front panel so as to be capable of folding into a plane generally parallel with a plane of the front panel when stowed and into planes generally orthogonal to the plane of the front panel when deployed to shade a visual display. The front panel includes an active antenna and each of the side panels include a parasitic antenna.

BRIEF DESCRIPTION OF THE DRAWINGS

The features and advantages of the present invention will be better understood with regard to the following description, appended claims, and accompanying drawings where:

DESCRIPTION

Figure 1:
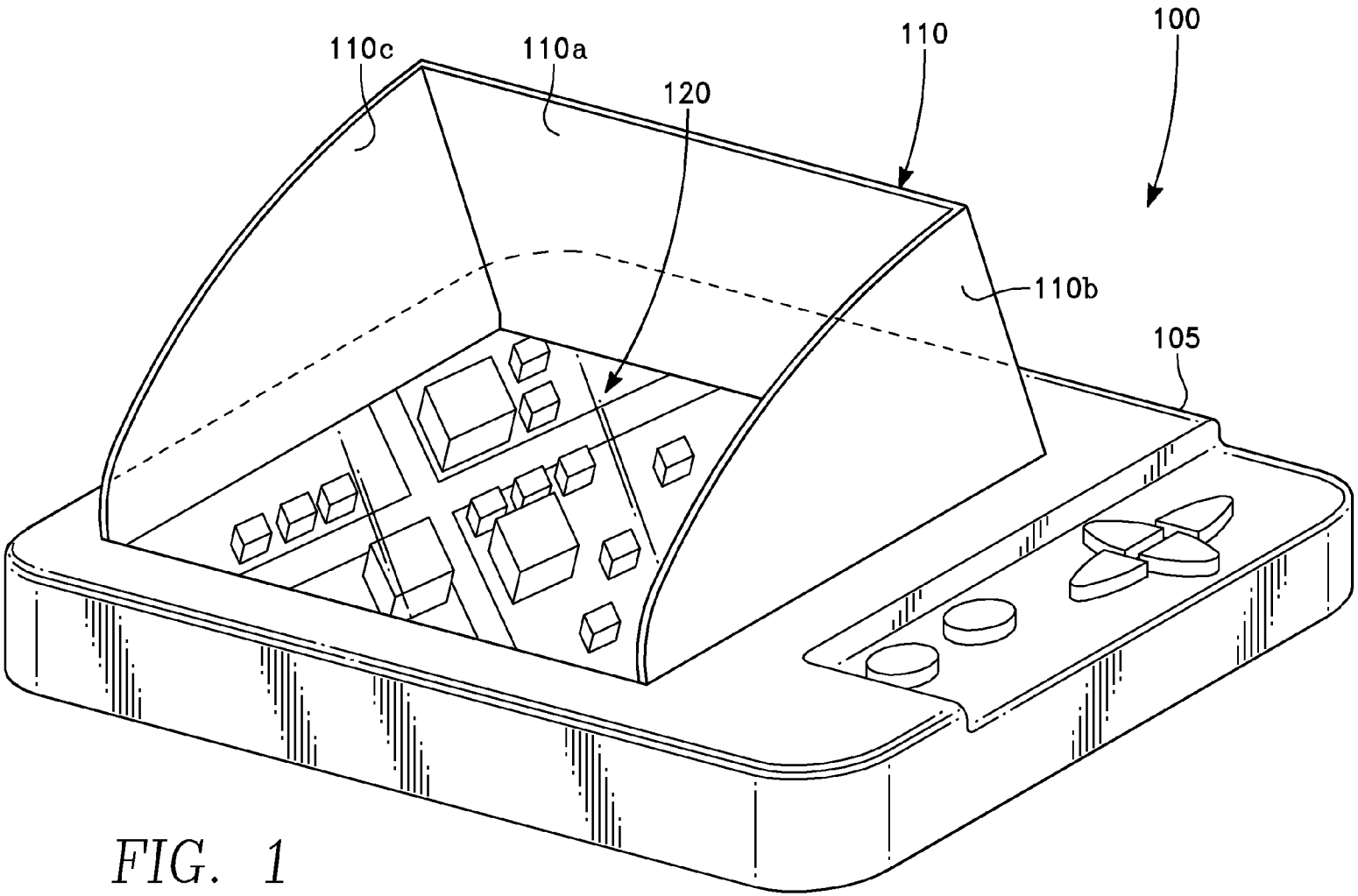
FIG. 1 shows a perspective view of a hand held remote control having a display shade with an integrated antenna.

FIG. 1 shows a perspective view of a hand held remote control 100 having a display shade 110 with an integrated antenna (not visible in FIG. 1). The display shade 110 shades the display 120 (shown displaying an urban street scene) from the sun to inhibit any reflective glare seen by the operator (not shown). The display shade 110 is three sided to provide shade for the operator as the operator orients the remote control 100 in the general direction of the remote control vehicle (not shown).

In operation, the operator is positioned behind the display shade 110 so that the operators body shields the display from sun shining onto the display from the side not shaded by the display shade 110. Being three sided not only allows the display shade 110 to combine with the operator's body to shade the display 120 from the sun on all sides, but also enables the display shade 110 to protect and shade the display 120 from precipitation, blowing sand, or other debris. Furthermore, the display shade 110 may be used in darkness to limit the amount of light from the display 120 that emanates to the outside surroundings.

In various embodiments, the side panels 110*b* and 110*c* are flexibly connected with the central panel 110*a* to allow the sides 110*b* and 110*c* to fold inward toward the center panel 110*a*. In such embodiments, the central panel 110*a* of the display shade 110 may be flexibly connected with the remote control 100 so that when the sides 110*b* and 110*c* fold inward toward the central panel 110*a*, the display shade 110 is able to fold flat and stow over the display 120. This allows the remote 100, the display shade 110, and the antenna to be lightweight, compact, easily portable, and robust. When stowed, the display shade 110 protects the display 120 from impact, abrasion, moisture, soiling, or other abuse, as well as hiding the display from observation. In the stowed position, the shade also protects the antennas (not visible in FIG. 1) within the shade from such abuses, and hides the antennas from observation.

In some embodiments, the display shade 110 may also, or alternatively be detachable. Thus, the central panel 110*a* may be fixedly, or detachably connected to the housing 105.

As shown in the embodiment shown in FIG. 1, optionally the display shade 110 may be angled back from normal to the display 120, toward the operator when the remote control vehicle (not shown) is an unmanned aerial vehicle or UAV. The antenna pattern will be oriented up in elevation toward the UAV. The central panel 110*a* is tilted back to provide a more useable pattern for UAVs, while at the same time it can provide better shade from the sun in the midday. The center of the antenna pattern beam is elevated toward the sky, so is ideal for mid to long range transmission/reception.

Figure 7A:
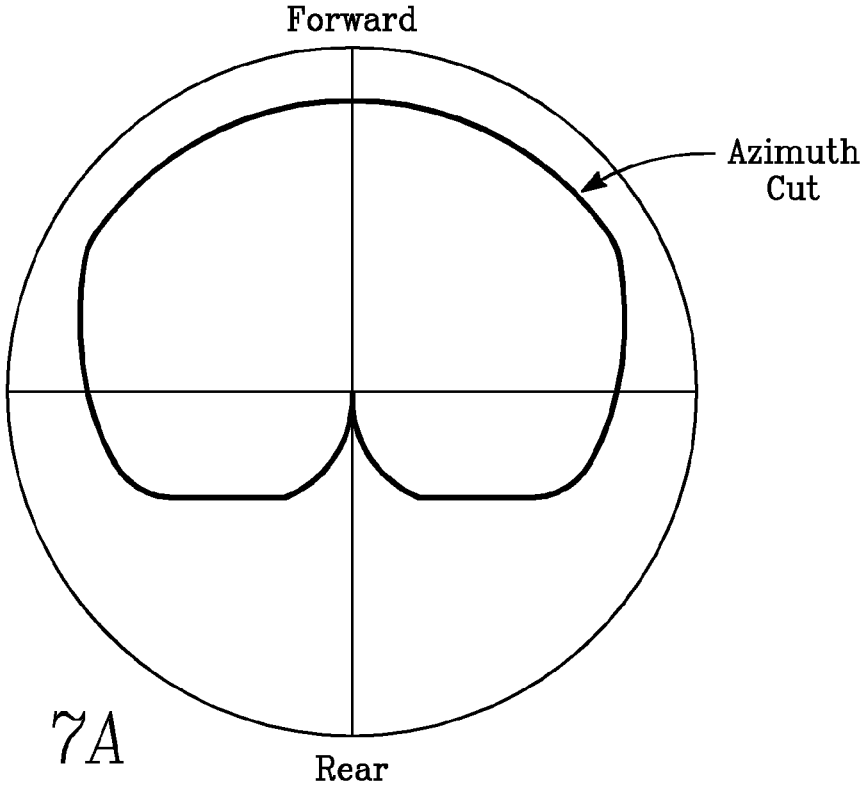
FIGS. 7A and 7B show an example antenna pattern in azimuth cut and elevation cut, respectively, for the antenna configuration of FIG. 3.
Figure 7B:
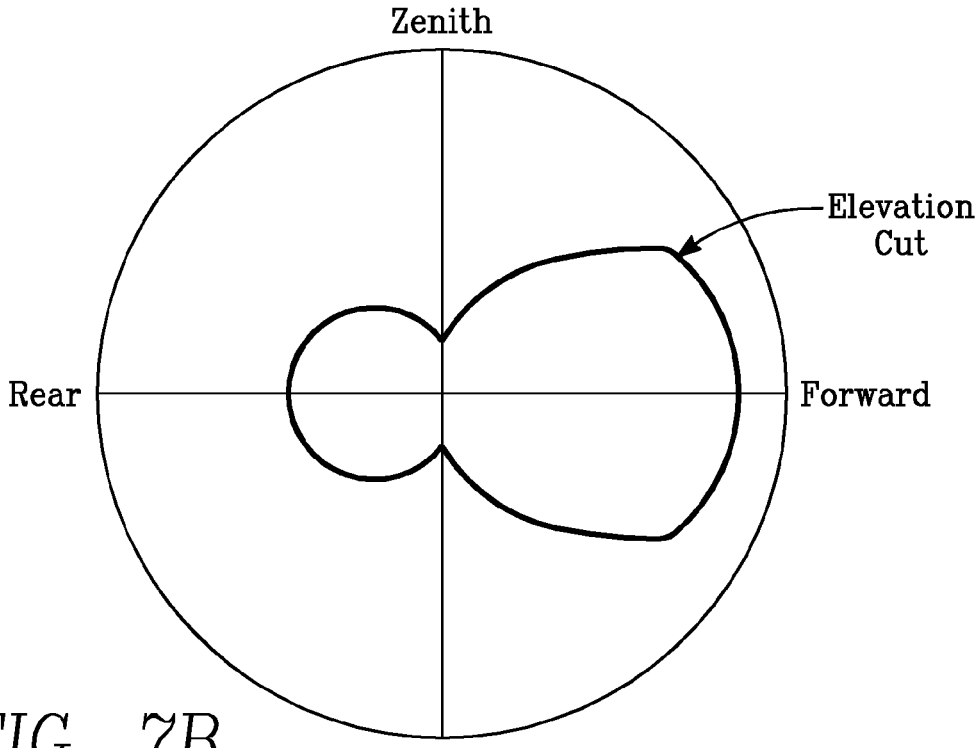

In other embodiments, such as for remote control ground vehicles, the display shade need not be angled back from normal and toward the operator, as shown in FIG. 7B.

Figure 2:
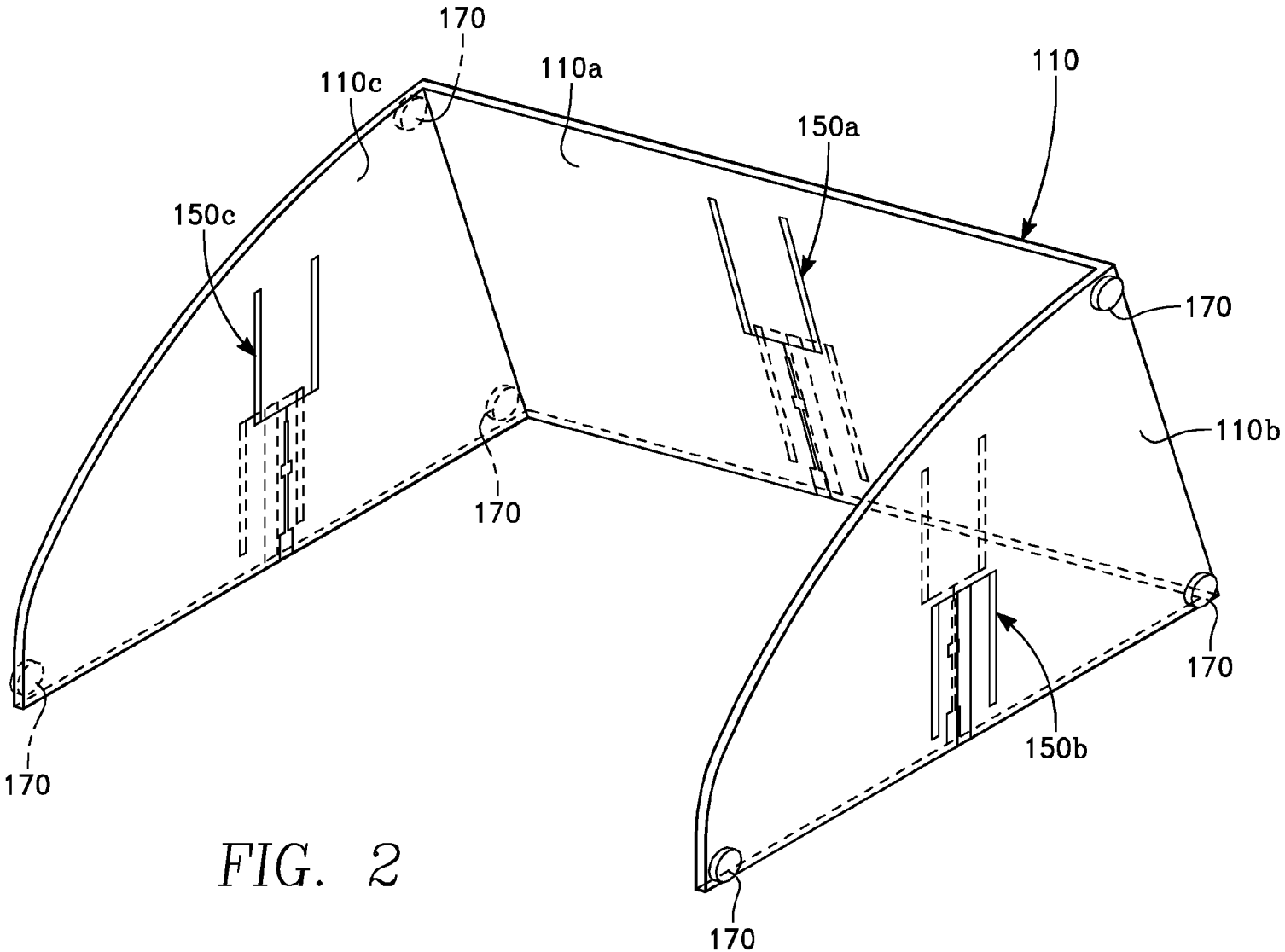
FIG. 2 shows an exploded perspective view of the display shade illustrating one embodiment of the display shade showing integrated antennas.

FIG. 2 shows an exploded perspective view of the display shade 110 illustrating one embodiment of the display shade 110 showing integrated antennas 150*a*, 150*b*, and 150*c*. Shown in this embodiment, are dipole antennas 150*a*, 150*b*, and 150*c* integrated into/onto the central and side panels 110*a*, 110*b*, and 110*c*, respectively. A fabric or other material covering (not shown in FIG. 2) transparent at the operating frequency of the antennas, covers the antennas 150*a*, 150*b*, and 150*c*, as illustrated in FIG. 1. This shields and protects the antennas 150*a*, 150*b*, and 150*c*, from abuse, and hides them from observation when deployed or stowed.

Figure 3:
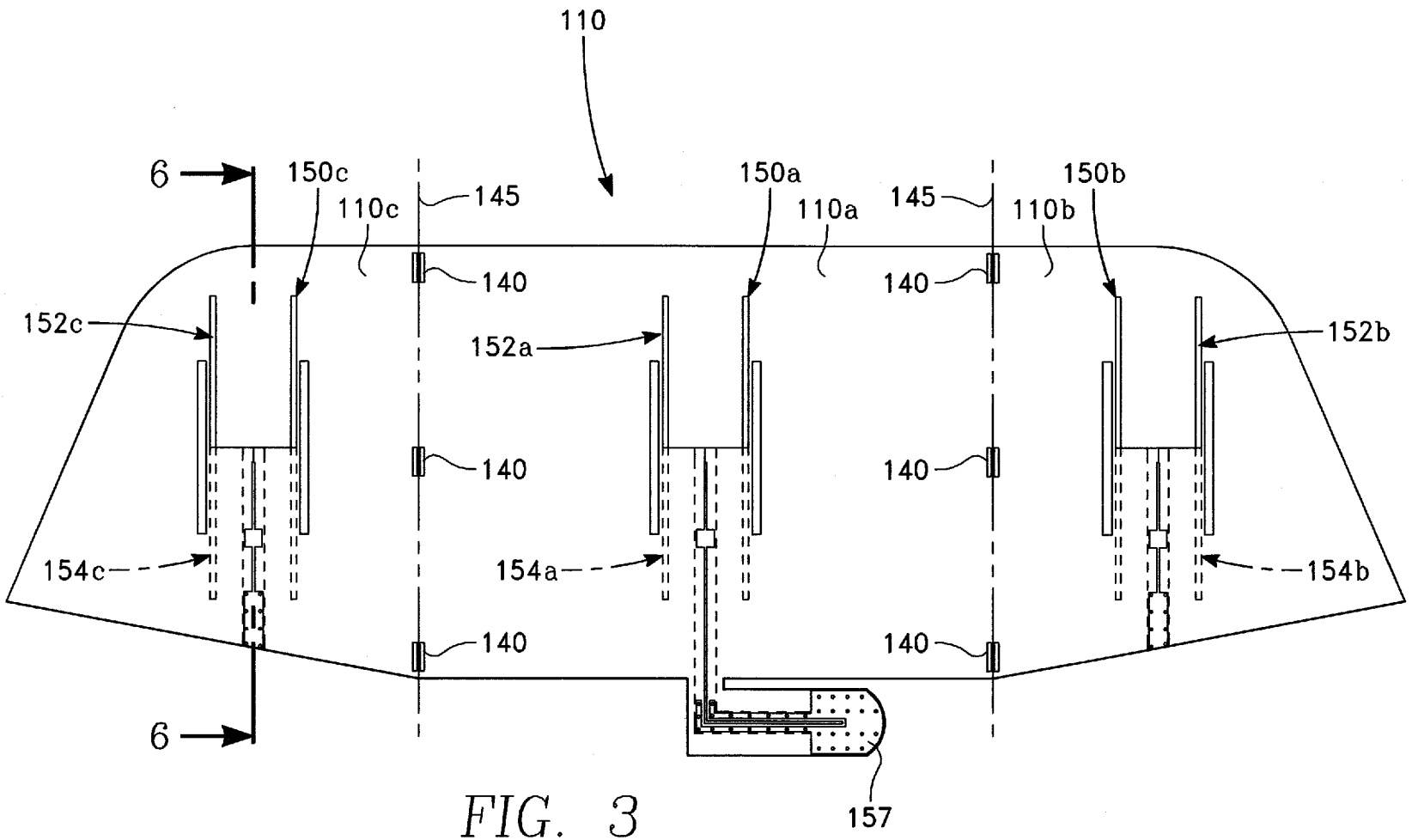
FIG. 3 shows a detailed flat top view of the display shade 110 without a material covering.

FIG. 3 shows a detailed flat top view of the display shade 110 without a material covering. The display shade 110 is folded along hinge lines or axes 145. Hinges 140, or other flexible connection, allow the side panels 110*b* and 110*c* to pivot about the connection with the central panel 110*a* to fit around the display 120 as shown in FIG. 1, and to fold against the central panel 110*a* and stowed along with the central panel 110*a* against the display 120.

Referring to FIG. 2, optional magnets 170 within side panels 110*b* and 110*c*, in cooperation with corresponding optional magnets (not shown) in the housing 105 of handheld remote control 100 (FIG. 1) adjacent to the display 120, may be provided to secure the side panels 110*b* and 110*c* with the housing 105 of the hand held remote control 100. In some embodiments, the magnets 170 keep the panels 110*a-c* deployed and/or stowed. Other securing means are possible, such as fasteners, snaps, clips, slots, clasps, pins, Velcro, or the like. Further, the securing means or an alternate securing means may secure the display shade 110 to housing 105 of the hand held remote control 100 when the display shade 100 is stowed/deployed over the display 120.

In the embodiment of FIG. 3, the central antenna 150*a* is an active antenna connected via connector interface 157 to send/receive signals, while the dipole antennas 150*b* and 150*c* in the side panels 110*b* and 110*c* are parasitic and not electrically connected, but influence the electromagnetic antenna pattern as discussed further below. The parasitic dipole antennas 150*b* and 150*c* when installed around the display 120 (FIG. 1) are oriented in opposing parallel planes and perpendicular to the central antenna 150*a* so that they provide a more advantageous antenna pattern as shown in FIGS. 7A and 7B. FIGS. 7A and 7B show an example antenna pattern in azimuth cut and elevation cut, respectively. The antenna pattern is a more directional pattern, as shown in the plot in FIG. 7A, which minimizes the energy going backward into operator's head. Instead, the antenna arrangement focuses it forward away from the operator and toward the remote control vehicle if the operator is facing the general direction of the remote control vehicle as shown in the plot in FIG. 7A.

Referring to FIG. 3, the dipole antennas 150*a*, 150*b*, and 150*c*, have portions 152 and 154 (shown in phantom line) that are located on opposite sides of a panel. Dipole antenna 150*a* has portions 152*a* and 154*a* located on opposite sides of the central panel 110*a*. Dipole antenna 150*b* has portions 152*b* and 154*b* located on opposite sides of the side panel 110*b*. Dipole antenna 150*c* has portions 152*c* and 154*c* located on opposite sides of the side panel 110*c*. In one embodiment, the antennas 150*a-c* are a copper material formed on panels 110*a-c* of printed wire board, or other such material. Other suitable antenna materials and panel materials may be used. Preferably, the panel material is substantially transparent at the operating frequencies.

Figure 4:
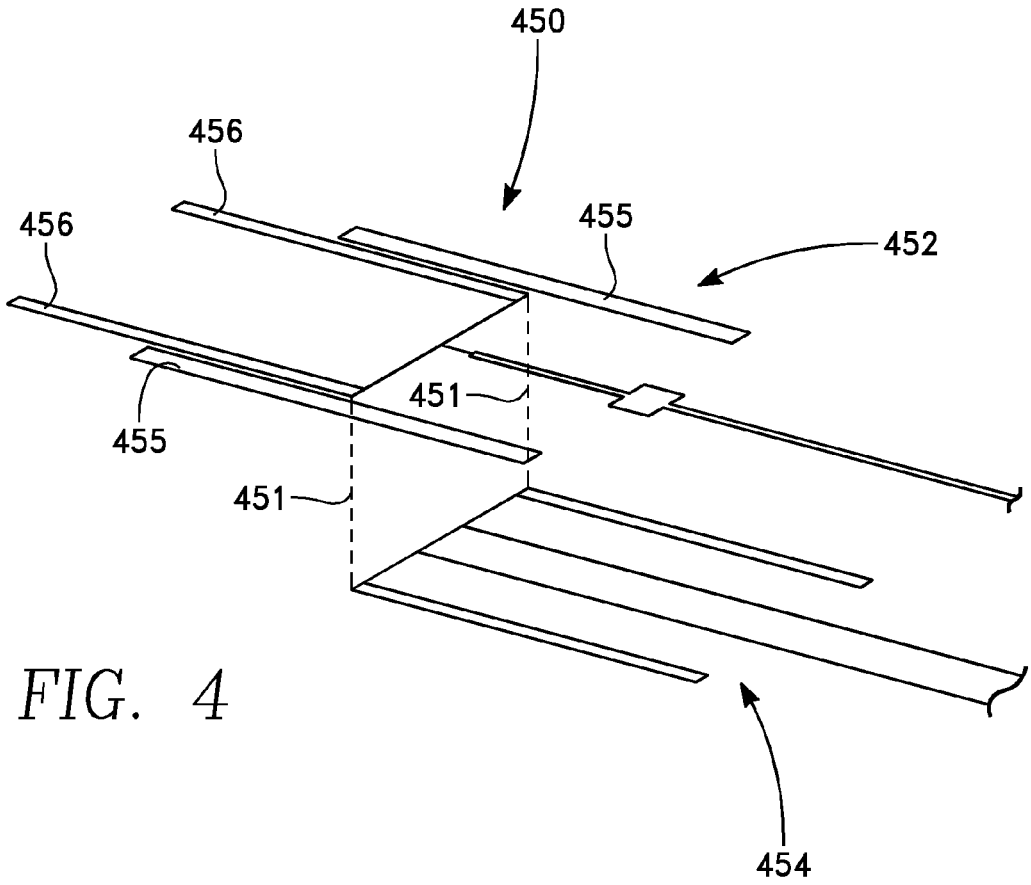
FIG. 4 shows of a perspective view schematic of the dipole antenna of various embodiments showing the electrical interconnection and placement of a single dipole antenna.

FIG. 4 shows of a perspective view schematic of the dipole antenna 450 of various embodiments showing the electrical interconnection and placement of a single dipole antenna 450. The dashed reference lines 451 are for reference and do not represent electrical connections. The portions 452 and 454 are on located on opposite sides of a panel (omitted in FIG. 4.

The dipole antenna 450 is a broadband antenna so is less sensitive to absorption or dielectric properties by the shield covering material and the body of operator. The antenna elements 456 are of a certain length, i.e. a multiple of one half of the wavelength at the center operating frequency, so that they resonate within a certain frequency range. The sleeves 455, sometimes referred to as a choke, are parallel to and space apart from the antenna elements 456, improve the element response and match over the desired operating frequency and gain of the dipole antenna 450. In various embodiments, the antennas 150*a*, 150*b*, 150*c* do not have to be identical, but should resonate in the same frequency range. The structures, however, may be different.

Figure 5:
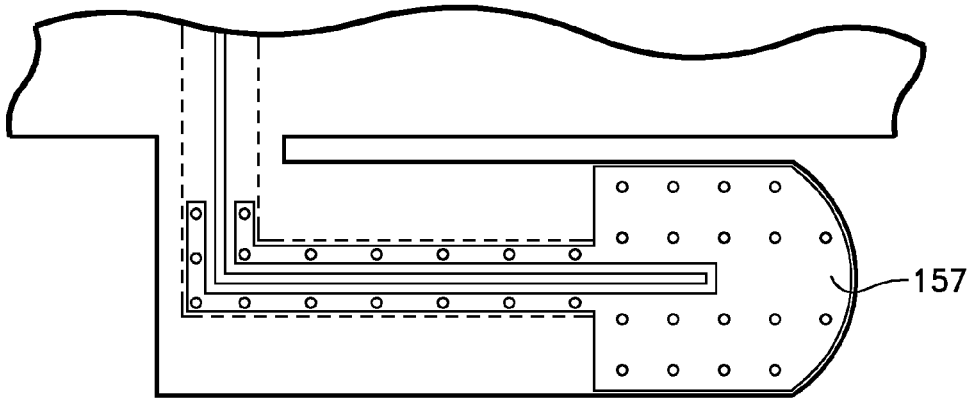
FIG. 5 shows an enlarged front schematic view of the connector of the active antenna of FIG. 3.

FIG. 5 shows an enlarged front schematic view of the connector interface 157 of the active antenna 150*a* of FIG. 3. The connector interface 157 is connected to electronics in the housing 105 (FIG. 1).

Figure 6:
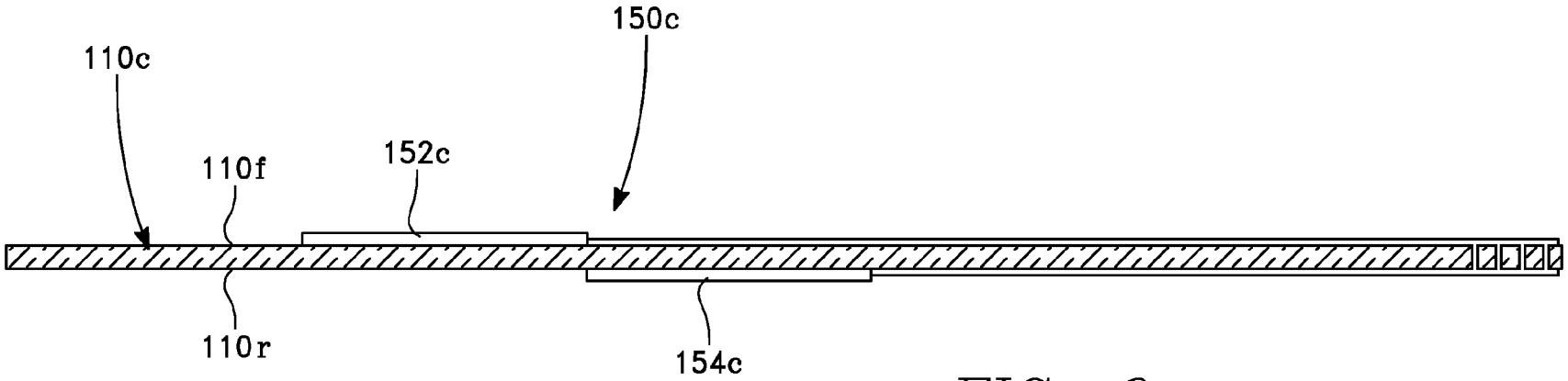
FIG. 6 shows a cut away side view of a parasitic antenna along the 6-6 line of FIG. 3.

FIG. 6 shows a cut away side view of a parasitic antenna 150*c* along the 6-6 line of FIG. 3. The antenna portions 152*c* and 154*c* are located on opposite sides 110*f* and 110*r* of the side panel 110*c*. The dipole antenna is a balance structure so does not require a ground plane so it is easier to implement in small device. In addition, because the dipole antenna array embodiment shown eliminates the ground plane, it reduces thickness and is lighter. This is especially important in portable, hand held remote control devices.

In alternate embodiments not shown, additional dipole elements may be included. The antenna configuration is not limited to two passive elements. Further, it is possible to stack dipoles to create more gain/range gain, or could add more on azimuth to improve azimuth gain/range. Thus, the antenna pattern can be tailored vertically or horizontally. The spacing of the antennas 150*a-c* adjusts the focus of the antenna pattern (shown in FIGS. 7A and 7B). FIGS. 7A and 7B show an example antenna pattern in azimuth cut and elevation cut, respectively, for the antenna configuration of FIG. 3, with vertically oriented, orthogonally positioned antennas.

Moreover, in yet other embodiments (not shown), multiple active antennas could be employed to detect signal quality in order to find best antenna(s) to transmit/receive and switch antenna(s) to steer or direct the beam base on signal quality. Directing the antenna pattern beam extends the range so allows the transmit power to be reduced conserve battery power, which can allow lightweight, smaller batteries.

One advantage of the present embodiments is that because the antennas are embedded in the display shade, there is a fixed relative spacing with 90 degrees separation between the antennas. In alternative embodiments, the antenna pattern could be reconfigurable by adding or removing parasitic antennas to change the directivity in the transmit/receive pattern. Some embodiments, as shown, have fixed distances between antennas. In other embodiments, the side panels or central panel may be changed or adjustable to change the configuration and adjust antenna pattern as desired.

The dipole antenna configuration shown in FIGS. 2 and 3 is for vertically polarized signals. In other embodiments, the orientation/polarization of the dipole antennas may be different.

Referring to FIGS. 1-3, in various embodiments a display shade 110 is provided with an integrated antenna 150 for use with a handheld remote control 100 with a visual display 120. The display shade 110 includes a central panel 110*a* and two side panels 110*b* and 110*c*. The side panels 110*b* and 110*c* may be mounted via hinges to the central panel 110*a* along parallel hinge lines 145. Each panel 110*a-c* may be made of a flexible printed circuit board material, and have a dipole antenna 150*a*, 150*b* and 150*c* centrally located in the panel. The dipole antennas 150*a*, 150*b* and 150*c* are parallel to the hinge lines 145. The hinged side panels 110*b* and 110*c* and central panel 110*a* allow the operator or user to fold the side panels 110*b* and 110*c* against the central panel 110*a* and collapse all the panels 110*a-c* over the display 120 to protect the display 120. In various embodiments, the shade 110 may be fixedly connected, or detachably connected to the housing 105 of the remote 100. Flexible materials in the shade 110 afford the operator comfort when the face of the operator is pressed against the edges of the shade 120.

Gain enhancement over standard dipole usage can be achieved by creating an array of dipole antennas, for example as shown in FIG. 2, or by increasing the aperture of the antenna. The out-of-plane triple dipole arrangement along the azimuth provides excellent Front-to-Back ratio (F/B) properties, minimizing any interaction with the operator, which could distort the main beam reception or transmission patterns shown in FIGS. 7A and 7B.

The arrangement where there is one active driven dipole antenna and two parasitic dipole antennas, and the resulting effect of a directional antenna is related to an array factor where the parasitic dipole antennas are coupled to the driven dipole antenna based on their relative physical position to the driven dipole element, is much more efficient than the standard array feeding where all the array elements are fed with certain amplitude and phase excitations.

As used herein the terms "display" include all visual displays including but not limited to display panels, display screens, projection displays, holographic projections or other projections, or other visual displays.

It is worthy to note that any reference to "one embodiment" or "an embodiment" means that a particular feature, structure, or characteristic described in connection with the embodiment may be included in an embodiment, if desired. The appearances of the phrase "in one embodiment" in various places in the specification are not necessarily all referring to the same embodiment.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated.

Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

Having described this invention in connection with a number of embodiments, modification will now certainly suggest itself to those skilled in the art. The example embodiments herein are not intended to be limiting, various configurations and combinations of features are possible. As such, the invention is not limited to the disclosed embodiments, except as required by the appended claims.

What is claimed is:

1. An integrated antenna and display shade for a wireless portable control unit comprising:

a) a stowable display shade comprising two side panels and a front panel between the two side panels, each of the two side panels being foldably connected to opposing edges of the front panel so as to be capable of folding into planes generally parallel with a plane of the front panel when stowed and into planes generally orthogonal to the plane of the front panel when deployed to shade a visual display;

b) the front panel comprising an active antenna; and c) each of the side panels comprising a parasitic antenna.

2. The integrated antenna and display shade of claim 1, wherein the active antenna is a dipole antenna.

3. The integrated antenna and display shade of claim 2, wherein the active antenna further comprises a sleeve.

4. The integrated antenna and display shade of claim 3, wherein each of the parasitic antennas further comprise a sleeve.

5. The integrated antenna and display shade of claim 2, wherein the front panel comprises a front face and a back face, and wherein the dipole antenna comprises a portion on the front face and a portion on the back face.

6. The integrated antenna and display shade of claim 2, wherein the parasitic antennas are dipole antennas.

7. The integrated antenna and display shade of claim 6, wherein each of the parasitic antennas further comprise a sleeve.

8. The integrated antenna and display shade of claim 6, wherein each dipole antenna has portions on both planar surfaces of its corresponding front or side panel.

9. The integrated antenna and display shade of claim 1, wherein the active dipole antenna and the parasitic antennas comprise portions on opposite planar surfaces of their corresponding front or side panel.

10. The integrated antenna and display shade of claim 1, wherein the front panel and side panels are configured such that the front panel is tilted toward the visual display such that the active antenna provides an elevated antenna pattern when the stowable display shade is deployed to shade the visual display.

11. A portable directional antenna structure for a wireless portable control unit comprising:

a) a foldable panel structure comprising two side portions and a front portion between the two side portions, each of the two side portions being foldably connected to opposing edges of the front portion so as to be capable of folding into a plane generally parallel with a plane of the front portion when stowed and into planes generally orthogonal to the plane of the front portion when deployed as a directional antenna;

b) the front portion comprising at least one active dipole antenna; and c) each of the side portions comprising at least one parasitic dipole antenna.

12. The portable direction antenna structure of claim 11, wherein the front portion is tilted back from normal such that the directional antenna provides an elevated antenna pattern when deployed.

13. The portable direction antenna structure of claim 11, wherein the at least one active antenna further comprises a sleeve.

14. The portable direction antenna structure of claim 13, wherein each of the parasitic antennas further comprises a sleeve.

15. The portable direction antenna structure of claim 11, wherein the at least one active dipole antenna and each of the at least one parasitic antennas comprise portions on opposite planar surfaces of their corresponding front or side portions.

16. A portable directional antenna structure for a wireless portable control unit comprising:

a) a first antenna formed on a first planar panel;

b) a second antenna and a third antenna formed on a second planar panel and a third planar panel, respectively;

c) the second planar panel and third planar panel being arranged generally orthogonal to the first planar panel; and d) the first antenna being configured as an active antenna, and the second antenna and the third antenna being configured as parasitic antennas.

17. The portable direction antenna structure of claim 16, wherein the first antenna, the second antenna, and the third antenna are dipole antennas.

18. The portable direction antenna structure of claim 17, wherein each of the first antenna, the second antenna, and the third antenna further comprise a sleeve.

19. The portable direction antenna structure of claim 17, wherein the first antenna, the second antenna, and the third antenna comprise portions on opposite planar surfaces of their corresponding first panel, second panel, and third panel.

20. The portable direction antenna structure of claim 16, wherein the second and the third panels are foldably connected to the first panel along axes, and wherein the first, second, and third antennas are generally parallel to the axes.

21. The portable direction antenna structure of claim 16, wherein the first planar panel is tilted back from normal such that the directional antenna provides an elevated antenna pattern.

22. A remote control device comprising:

a) a display;

b) a display shade partially surrounding the display, the display shade comprising a first planar panel, a second planar panel, and a third planar panel, the second planar panel and third planar panel being arranged generally orthogonal to the first planar panel; and c) a directional antenna structure comprising:

i) a first antenna formed on the first planar panel;

ii) a second antenna and a third antenna formed on the second planar panel and the third planar panel, respectively; and iii) the first antenna being configured as an active antenna, and the second antenna and the third antenna being configured as parasitic antennas.

23. The remote control device of claim 22, wherein the first panel of the display shade is tilted toward the display such that the directional antenna provides an elevated antenna pattern.

24. The remote control device of claim 22, wherein the second and the third panels are foldably connected to the first panel.

25. The remote control device of claim 22, wherein the second and the third panels are foldably connected to the first panel along axes, and wherein the second and third antennas are generally parallel to the axes.

26. The remote control device of claim 22, wherein the display shade is capable of folding to cover the display.

27. The remote control device of claim 22, wherein the first antenna is a dipole antenna.

28. The remote control device of claim 27, wherein the second and the third antennas are dipole antennas.

29. The remote control device of claim 22, wherein the first antenna is a sleeved dipole antenna.

30. The remote control device of claim 29, wherein the second and the third antennas are sleeved dipole antennas.

* * * * *